US007737814B1

(12) United States Patent
Damnjanovic

(10) Patent No.: US 7,737,814 B1
(45) Date of Patent: Jun. 15, 2010

(54) ELECTROSTATIC SHIELD AND VOLTAGE TRANSFORMER

(76) Inventor: Aleksandar Damnjanovic, 396 Ventura Dr., Oldsmar, FL (US) 34677

( * ) Notice: Subject to any disclaimer, the term of this patent is extended or adjusted under 35 U.S.C. 154(b) by 11 days.

(21) Appl. No.: 12/313,720

(22) Filed: Nov. 24, 2008

(51) Int. Cl.
*H01F 27/36* (2006.01)

(52) U.S. Cl. ..... 336/84 R; 336/145; 336/147

(58) Field of Classification Search ..... 336/84 R
See application file for complete search history.

(56) References Cited

U.S. PATENT DOCUMENTS 4,017,815 A * 4/1977 Sauer ..... 336/70
4,124,822 A * 11/1978 Naylor ..... 330/10
4,318,066 A * 3/1982 Degeneff et al. ..... 336/70
4,459,576 A * 7/1984 Fox et al. ..... 336/84 C
5,990,775 A * 11/1999 Inui et al. ..... 336/84 C
2008/0018425 A1* 1/2008 Lu et al. ..... 336/84 C

* cited by examiner

*Primary Examiner*—Anh T Mai
(74) *Attorney, Agent, or Firm*—Michael J. Persson; Lawson & Persson, P.C.

(57) ABSTRACT

An electrostatic shield and a voltage transformer having a high voltage winding and a low voltage winding. The shield takes the form of a concentric winded coil, made from a round conductive wire having a layer of insulation around it and a radius of at least ten times the radius of the wire used for the high voltage winding. This shield is dimensioned to surround the high voltage winding of the transformer.

12 Claims, 6 Drawing Sheets

ELECTROSTATIC SHIELD AND VOLTAGE TRANSFORMER

FIELD OF THE INVENTION

The present invention relates to the field of voltage transformers and, in particular to electrostatic shields for medium voltage resin cast voltage transformers and medium voltage resin cast voltage transformers utilizing these shields.

BACKGROUND OF THE INVENTION

A voltage transformer steps down the voltage of a circuit to a low value that can be effectively and safely used for operation of instruments, such as voltmeters, watt meters, and relays used for various protective purposes. They are designed for relatively low power but high accuracy and high reliability.

A problem lies in the design of an insulation system for a voltage transformer that will withstand the use to which is intended. The most likely contributor to failure of an insulator under electric field stress is partial discharge. Partial discharge, also referred to as corona, is the ionization of a gas, such as air, within a void or gap in the insulation system when the electric field stress exceeds a critical value. The magnitude of the discharge is dependent on the number and size of the voids within the insulation system. The consequence of allowing discharges to occur anywhere within the insulation system is a significant reduction in the life of the insulating material. Organic insulating materials will ultimately fail when exposed to continuous discharge conditions, and the time to failure usually varies as the inverse of the voltage stress.

Medium voltage resin-cast voltage transformers have low and high voltage windings of concentric layer-wound type coils. The transformer coils consist of layers of low and high voltage windings and shields that are disposed so as to give uniform distribution of electrical field, thus reducing partial discharge and increasing impulse voltage strength. A major requirement for the reliable and safe operation of the voltage transformers is the performance of its insulation. Partial discharge activity can initiate under normal working conditions in high voltage equipment in cases where the insulation condition has deteriorated with age and or has been aged prematurely by thermal over-stressing. Thus, the voltage transformer needs to be designed so that the electrical field is below the critical value of the insulation system under normal working conditions. Because of the high non-uniformity of the electrical field, it requires techniques and methods for its regulation below the critical value.

Field regulation techniques may be used in any transformer or inductor, but are more applicable to those encapsulated in resin. One of the techniques used for making the electrical field more uniform is using electrical shielding with rounded electrodes. These shields have traditionally been made of conductive materials, usually folded edge copper foils. However, there are a number of complications and difficulties inherent in making of this kind of shield. For example, it is difficult to fold the foil because it is not possible to make a full turn and it is not possible to achieve a uniform radius throughout the entire shield length. Further, the edges of the foil can create problems with field regulation. The combination of the non-uniformity of radius and edges prevent these foil-based shields from maintaining a uniformity of the electrical field.

A number of issued patents address the issue of avoiding partial discharge activity, but each has significant drawbacks. For example, U.S. Pat. No. 2,942,215, titled "Corona shield" discloses the use of an insulated conductor that is disposed along the edge of the windings between the core and the windings of the transformer and grounded. These shields are said to distribute the dielectric stress that builds up on the edges of metal parts adjacent to transformer winding subjected to high potentials to prevent corona. However, the purpose of these shields is to regulate the electrical field of the edge of the ground electrode magnetic core and, hence, control the field at one point. Accordingly, they do not provide uniform voltage distribution over the entire winding space and do not control the electrical field at the edge of the coil. Further, the fact that these shields are grounded makes them unsuitable for use in medium voltage resin-cast voltage transformers.

U.S. Pat. No. 3,678,428, titled "Interwinding shield for power transformers" discloses a shield constructed from interleaved layers of insulating and conducting strips that are assembled into an insulating member and placed around the low voltage winding of the transformer. The interleaving of this shield makes is very difficult to manufacture, as each separate layer must be precisely manufactured and each layer precisely arranged and secured. Further, the interleaving arrangement is not a robust mechanical arrangement and the precisely manufactured layers are easily bent out of their desired orientation.

U.S. Pat. No. 3,699,488, titled "Distribution Transformer Having Static Shield", discloses a shield consisting of a strip of aluminum-backed crepe paper overlaid on the outer wire turn of the transformer. The edges of the strip are folded over and flattened so that the aluminum is on the inside of the fold to provide minimum edge corona. This shielding has the same drawbacks as those discussed above; namely they are difficult to fold and the edges create non-uniformity in the field. Further, because these shields have elongated thin strip of insulation, such a paper with conductive coating, they are complex and costly to manufacture.

U.S. Pat. No. 4,379,999, titled "Electrostatic shield for a transformer" discloses an electrostatic shield for an electrical transformer that has a substantially ring-shaped inner insulator of asymmetric vertical cross-section with one surface being substantially planar and the other being curved. This shield is formed from multiple layers of conductive foil, and multiple layers of other insulators, including at least one layer of polyethylene terephthalate (PET) film and at least one mica insulation layer with mica bonded to a non-conductive backing film such as glass tape or PET film by a bonding agent such as epoxy resin. This shield is said to improve the dielectric strength of the electrostatic shield. However, it is difficult to manufacture due to the use of foils and multiple different insulting layers that must be bonded together. Further, the fact that it is an outer shield in which both coils are inside the shield limits its applicability.

U.S. Pat. No. 4,652,846, titled "Small transformer with shield" discloses a transformer having and a stamped metal foil frame as the shielding wall between the adjacent face flanges of the coil. The stamped metal foil frame is a single piece of flat metal foil having non-folded edges and an opening between two of the four sides. This shield is much easier to manufacture than the folded foil and multiple layered shields of other devices. However, it is not effective at preventing partial discharge, which is required in the high voltage applications, due to the fact that the sharp edges of the stamped shield create an unstable field, which cannot be easily controlled.

Finally, U.S. Pat. No. 4,845,453, titled "High-voltage voltage transformer with shields" discloses a high-voltage voltage transformer having a core surrounded coaxially by a high and low voltage windings and a slotted metal shield, a shielding electrode at ground potential and surrounding the high and low voltage windings, and a discharge electrode spaced at a slight distance from the metal shield. However, this shield is an outer shield used in construction of high voltage instrument transformers of head type and is not adapted for use in medium voltage resin cast voltage transformers. Further, this shield is also complex and expensive to manufacture and requires the use of special manufacturing tools.

Therefore, there is a need for an electrostatic shield for medium voltage resin cast voltage transformers that will allow the voltage transformer to withstand the use to which is intended, that will provide a uniform distribution of electrical field, that will reduce partial discharge and increase impulse voltage strength, that is relatively inexpensive and easy to manufacture, that is not easily damaged during the manufacturing process, and that is not limited to use in transformers in which both coils are inside of the shield.

SUMMARY OF THE INVENTION

The present invention is an electrostatic shield for a voltage transformer and a voltage transformer using the electrostatic shield. In its most basic form, the electrostatic shield includes a coil including a plurality of windings of a substantially round shield wire. The coil includes a first turn terminating in a starting end, a last turn terminating in a finishing end, and a plurality of intermediate turns. The first turn, last turn and plurality of intermediate turns define an inside shield coil surface and an outer shield coil surface. A layer of insulation is disposed about a substantial portion of the shield wire. The layer of insulation terminates a sufficient distance from the starting end and the finishing end to allow the starting end and the finishing end to be electrically connected to the high voltage winding. The inside shield coil surface is dimensioned to surround the high voltage winding; and the shield wire has a shield wire diameter that is at least ten times the diameter of the wire used to form the high voltage winding.

In then preferred embodiment of the electrostatic shield, the shield wire is a copper wire having a diameter of between 0.05 inches and 0.12 inches.

In its most basic form, the voltage transformer includes a magnetic core, a low voltage winding, a pair of low voltage leads in electrical communication with the low voltage winding, a high voltage winding formed from a high voltage winding wire having a high voltage winding wire diameter, a pair of high voltage leads in electrical communication with the high voltage winding; and the electrostatic shield of the present invention. The electrostatic shield includes an inner shield coil and an outer shield coil. The inner coil and the outer coil each include a plurality of windings of a substantially round shield wire, and include a first turn terminating in a starting end, a last turn terminating in a finishing end, and a plurality of intermediate turns. The first turn, last turn and plurality of intermediate turns define an inside inner coil surface and an outside inner coil surface, and each of the inner coil and the outer coil are connected to the high voltage winding. A layer of insulation is disposed about a substantial portion of the shield wire of the outer coil and the inner coil. The layer of insulation terminates a sufficient distance from the starting end and the finishing end to allow the starting end and the finishing end to be electrically connected to the high voltage winding. The inside shield coil surface of the outer coil surrounds and is substantially proximate to the high voltage winding and the outer shield coil surface of the inner coil surrounds and is substantially proximate to the high voltage winding. Finally, the shield wire has a diameter that is at least ten times the high voltage winding wire diameter.

In one embodiment of the transformer, the high voltage winding includes a first high voltage winding section, a second high voltage winding section, and a space separating the first high voltage winding section and the second high voltage winding section. The outer coil includes a first outer coil surrounding the first high voltage winding section and a second outer coil surrounding the second high voltage winding section. In these embodiments, it is preferred that the first high voltage winding section and the second high voltage winding section of the transformer are connected by a central wire and the central wire is connected to the inner coil.

In the preferred embodiment, the voltage transformer is a medium voltage resin cast transformer and the shield wire is a copper wire having a diameter of between 0.05 inches and 0.12 inches. In this embodiment, the shield and the high voltage coil are sized and dimensioned such that an induced voltage in the shield is less then thirty Volts.

In another embodiment of the voltage transformer, the shield and the high voltage coil are sized and dimensioned such that an induced voltage in the shield is at least ten times lower than an induced voltage in the high voltage winding. In still another embodiment, the high voltage coil are sized and dimensioned such that the transformer provides substantially uniform capacitance.

The shield of the present invention overcomes the drawbacks inherent in prior art electrostatic shields and voltage transformers using these shields. This shield provides a better distribution of electrical field thus suppressing partial discharges, and provides more uniform distribution of the impulse voltage through the winding.

The present invention provides the advantage of minimizing partial discharge in the insulation system and increasing the impulse strength of the dielectric system. The new shield is easier to construct and mount on the transformer, the time consumed to making the shield is shortened, and the quality and reliability of the transformer is improved. Further, the edge radius of the shield can be controlled by the size of the wire used to form it and, consequently, the uniformity of the electrical field is easily controlled. Thus, the performance of the voltage transformers is improved, and the transformers have significantly better partial discharge characteristics and more uniform distribution of the voltage impulse through the shield.

Therefore, it is an aspect of the invention to provide an electrostatic shield for medium voltage resin cast voltage transformers that will allow the voltage transformer to withstand the use to which is intended.

It is a further aspect of the invention to provide an electrostatic shield for medium voltage resin cast voltage transformers that will provide a uniform distribution of electrical field.

It is a further aspect of the invention to provide an electrostatic shield for medium voltage resin cast voltage transformers that will reduce partial discharge and increase impulse voltage strength.

It is a further aspect of the invention to provide an electrostatic shield for medium voltage resin cast voltage transformers that is relatively inexpensive and easy to manufacture.

It is a further aspect of the invention to provide an electrostatic shield for medium voltage resin cast voltage transformers that is not easily damaged during the manufacturing process.

It is a further aspect of the invention to provide an electrostatic shield for medium voltage resin cast voltage transformers that is not limited to use in transformers in which both coils are inside of the shield.

These aspects of the invention are not meant to be exclusive and other features, aspects, and advantages of the present invention will be readily apparent to those of ordinary skill in the art when read in conjunction with the following description, appended claims and accompanying drawings.

DETAILED DESCRIPTION OF THE INVENTION

Figure 1A:
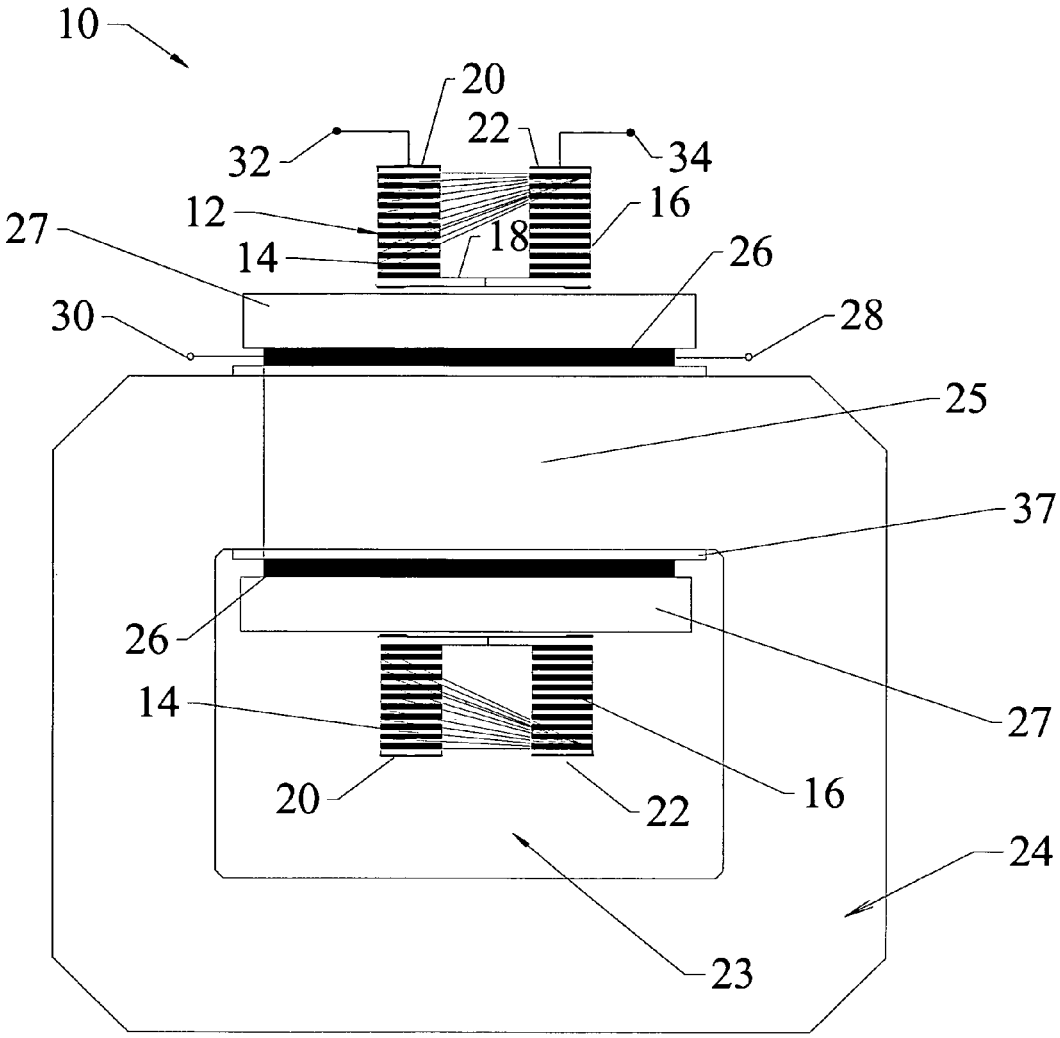
FIG. 1A PRIOR ART
FIG. 1 is a cross sectional view of a prior art voltage transformer constructed from two sections in which folded foil shields and provided in a winding arrangement.

Referring first to FIG. 1A, one type of conventional transformer 10 includes a magnetic core 24 about which a low voltage winding 26 and high voltage winding 12 are wound. The low voltage winding 26 is in electrical communication with a pair of low voltage leads 28, 30 that extend outside of the magnetic core 24. The high voltage winding 12 is made of two high voltage winding sections 14, 16 and includes a pair of high voltage leads 32, 34 that extend from the two high voltage winding sections 14, 16. The low voltage winding 26 is insulated from the high voltage winding 12 by a plurality of layers of inter-winding insulation 27, preferably Nomex® brand insulating material, and is insulated from the magnetic core 24 by another plurality of layers of low voltage winding insulation 37, also preferably Nomex® brand insulating material. The magnetic core 24 includes a hollow winding window 23 through its center. The high voltage winding 12, low voltage winding 26, intertwining insulation 27 and low voltage winding insulation 37 are wound about the top portion 25 of the core 24 such that they pass through the winding window 23.

Figure 1B:
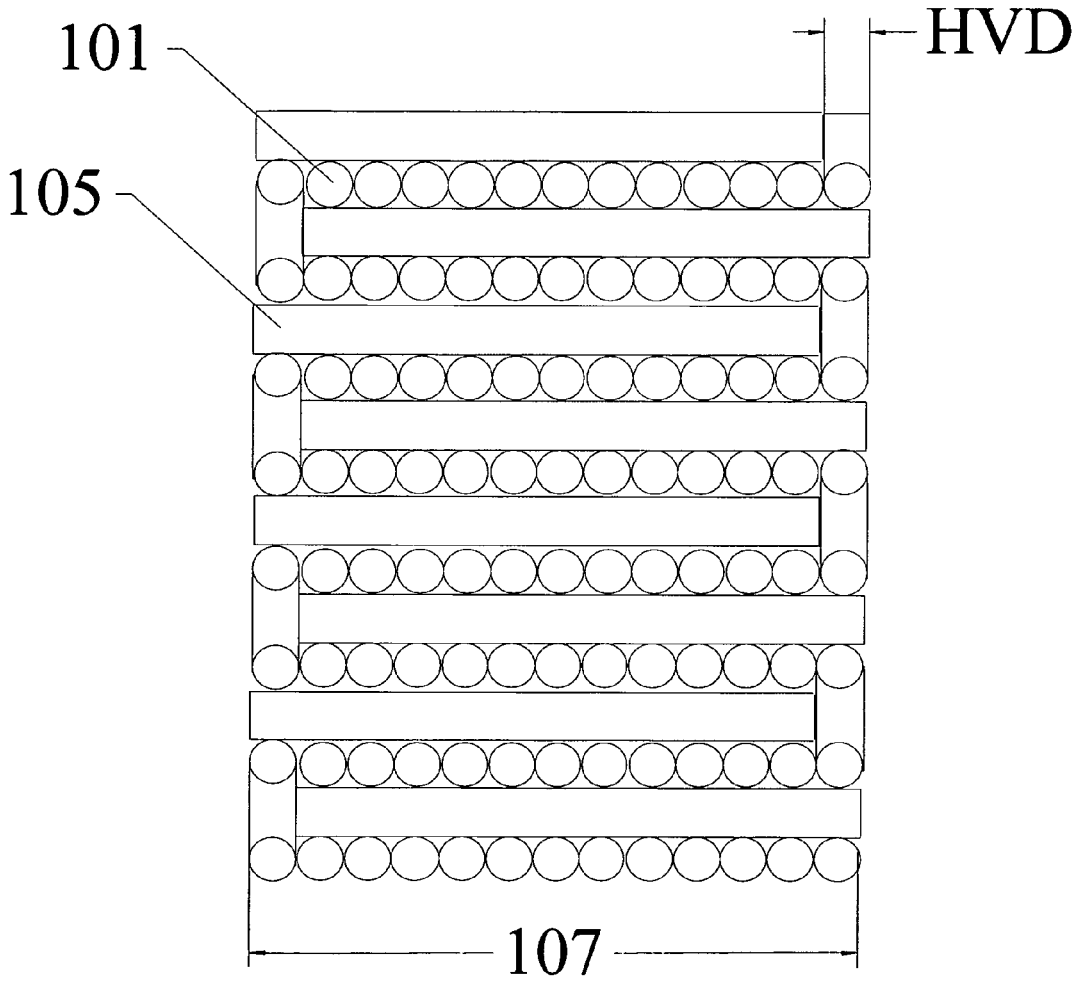
FIG. 1B PRIOR ART

As shown in FIG. 1B, the high voltage winding sections 14, 16 are formed by winding a round high voltage winding wire 101 having a high voltage winding diameter HWD about a portion of the magnetic core 24, to form a high voltage winding wire layer 107. A layer of insulation 105, preferably Nomex® brand insulating material, is then disposed upon the high voltage winding wire layer 107 and then a second layer is disposed over the first high voltage winding wire layer 107. This process is repeated until the high voltage winding is complete. It is noted that FIG. 1B only shows eight layers, but that a typical high voltage winding 12 may have sixty or more layers wrapped about the magnetic core 24.

In this type of transformer, the high voltage winding 12 is disposed between a top cylindrical shield 18 that extends across both high voltage winding sections 14, 16, and two bottom shields 20, 22, each of which extends across only one of the high voltage winding sections 14, 16. When the voltage transformer 10 is made from two equal high voltage winding sections 14, 16, the high voltage winding sections 14, 16 are connected at the starting ends of the winding sections and to the inner shield 18. It is noted that adjoining layers of turns of the high voltage winding 12 are insulated from one another and from the shields 18, 20, 22 by a suitable insulating material. However, this insulating material has been omitted from FIGS. 1A, 2, 4 and 5 for purposes of clarity.

Figure 2:
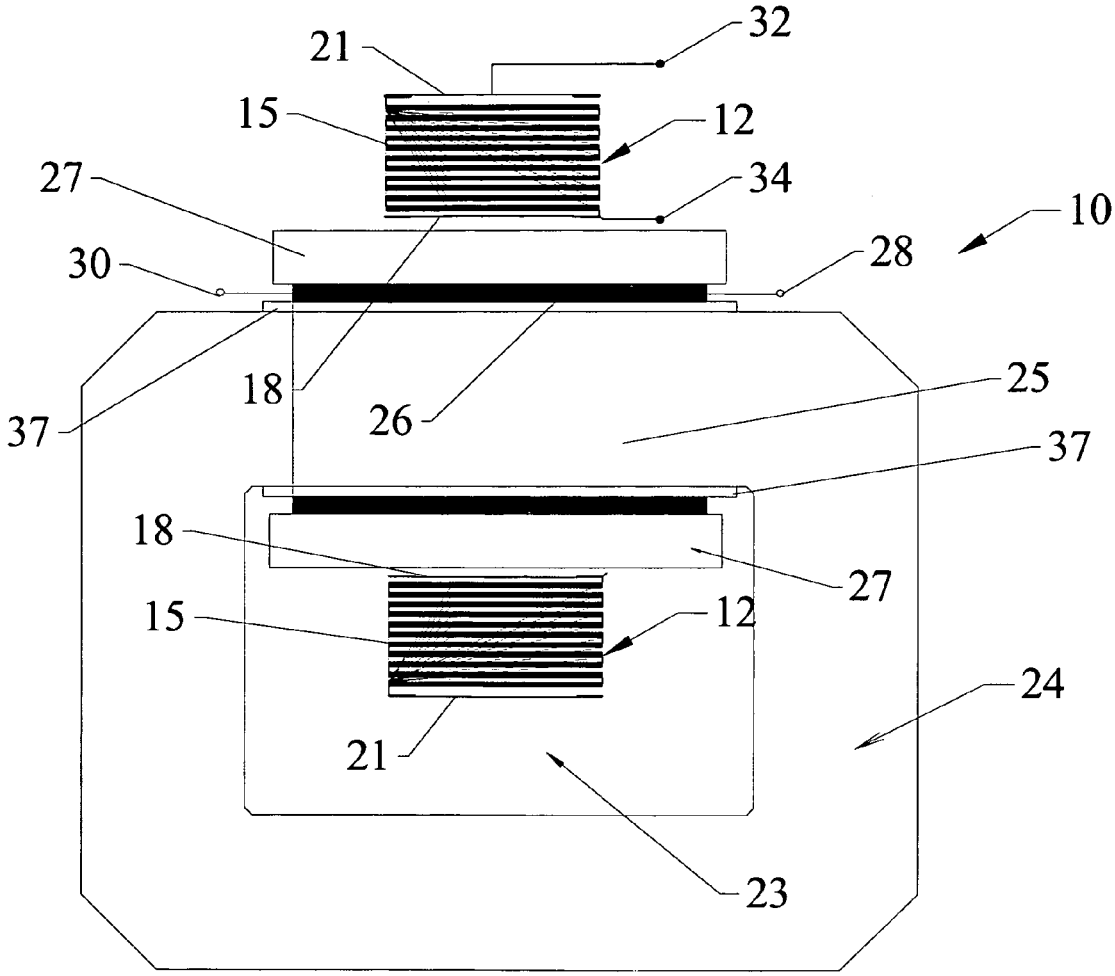
FIG. 2 PRIOR ART
FIG. 2 is a cross sectional view of a prior art voltage transformer constructed from one section for operation between lines in which folded foil shields and provided in a winding arrangement.

Another type of conventional transformer 10 is shown in FIG. 2. This type of transformer 10 is similar to the transformer of FIG. 1 insofar as it includes a low voltage winding 26 and high voltage winding 12 and the low voltage winding 26 is in electrical communication with a pair of low voltage leads 28, 30 that extend outside of the magnetic core 24. However, in this type of transformer, the high voltage winding 12 is made from a single high voltage winding section 15, which is connected to a top cylindrical shield 18 and a bottom cylindrical shield 21, each of which extend across the high voltage winding section 15 of the high voltage coil 12. In this type of transformer, the high voltage leads 32, 34 extend from the top shield 18 and the bottom shield 21.

The shields 18, 20, 21, 22 in the embodiments of FIGS. 1 and 2 are each made in form of a thin copper foil with the folds on each side. The foil is insulated so it is an open circuit. The starting end layers of the high voltage coil 12 proximate to top shield 18 are wound directly over the folded edges of the foil, the finish end of the coil 12, proximate to the bottom shields 20, 21, 22, is soldered to the end foil, and the foil is insulated using Kraft® paper, Nomex® brand insulation, or other art recognized insulating materials to prevent a shorted turn.

The present invention is predicated in part on the discovery that a shielding system that prevents partial discharge in medium class voltage transformers, defined as transformers operating in the medium voltage range of between 5 kV and 25 kV, can be achieved without the need for complex and costly techniques and methods by using a shield that minimizes the non-uniformity of the electrical field so the field strength is below the critical value of the insulation system. The shield of the present invention accomplishes this.

Figure 3:
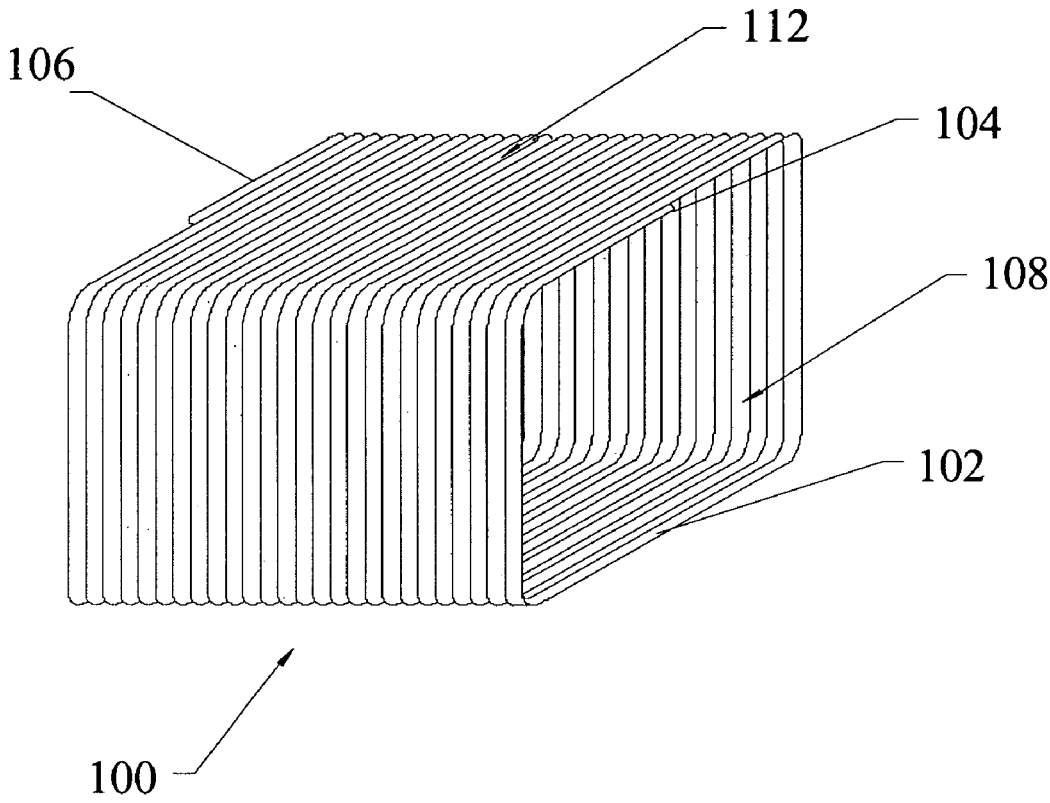
FIG. 3 is an isometric view of one embodiment of the electrostatic shield of the present invention.

As shown in FIG. 3, the shield 100 of the present invention is made from round shield wire 102. The shield wire 102 is preferably copper or aluminum wire between AWG 10 gauge and 15 gauge and has a shield wire diameter SD (See FIGS. 4 and 5) that is at least ten times the high voltage wire diameter HVD (See FIG. 1B) of the wire used for the high voltage winding, to provide quasi-uniform voltage distribution The shield wire 102 is preferably insulated with an insulation class that is the same, or similar to, that of the high voltage winding. The specific material and thickness will depend on the transformer design requirements, temperature class, and voltage class. However, the insulation is disposed about a substantial portion of said shield wire 102 and terminates a sufficient distance from the starting end 105 and said finishing end 107 to allow the starting end and said finishing end to be electrically connected to the high voltage winding.

The shield wire 102 is concentrically wound from the starting end 105 of the first turn 104 to the finishing end 107 of the last turn 106, with ten to thirty intermediate turns 109 preferably disposed between the first turn 104 and the last turn 106, depending upon the voltage range and design. Although the shield 100 of FIG. 3 takes the form of a hollow rectangular prism, the shape of the shield 100 is primarily a function of the shape of the core around which it is disposed. Accordingly, were the core to have a cylindrical, oval, or other shape, the shield 100 would likewise take such a shape.

Figure 4:
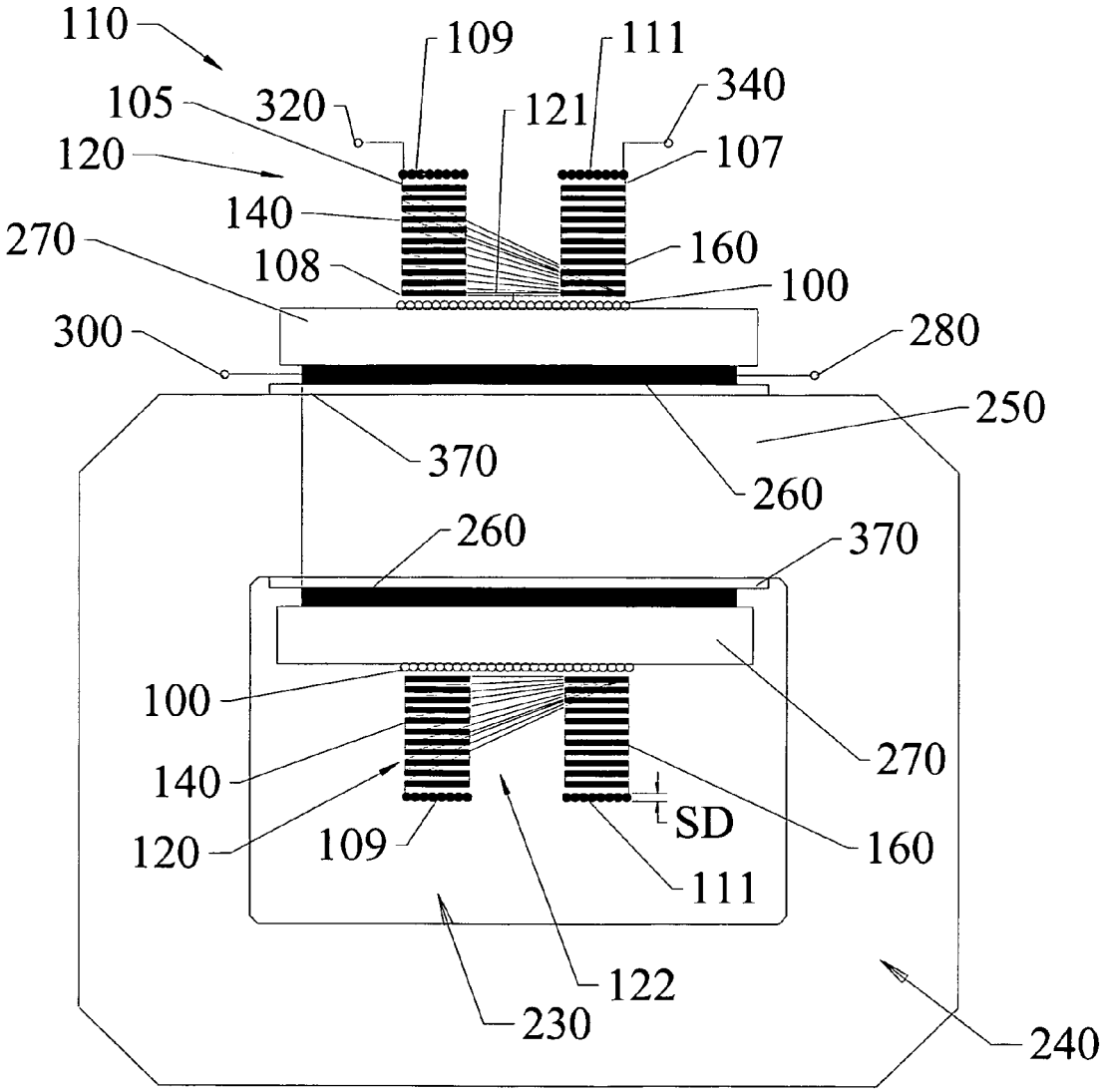
FIG. 4 is a cross sectional view of a voltage transformer of the present invention constructed from two sections in which the electrostatic shield of the present invention is utilized.

Referring now to FIG. 4, one embodiment of a transformer 110 in accordance with the present invention is shown. Like the prior art transformer 10 of FIG. 1, the transformer 110 includes a magnetic core 240 about which a low voltage winding 260 and high voltage winding 120 are wound. The low voltage winding 260 is in electrical communication with a pair of low voltage leads 280, 300 that extend outside of the magnetic core 240. The high voltage winding 120 is made of two high voltage winding sections 140, 160, which are separated by a space 122, and includes a pair of high voltage leads 320, 340 that extend from the two high voltage winding sections 140, 160. The low voltage winding 260 is insulated from the high voltage winding 120 by a plurality of layers of inter-winding insulation 270, preferably Nomex® brand insulating material, and is insulated from the magnetic core 240 by another plurality of layers of low voltage winding insulation 370, also preferably Nomex® brand insulating material. The magnetic core 240 includes a hollow winding window 230 through its center. The high voltage winding 120, low voltage winding 260, intertwining insulation 270, low voltage winding insulation 370 outer shields 109, 111 and inner shield 100 are wound about the top portion 250 of the core 240 such that they pass through the winding window 230.

The main difference between the transformer 110 of FIG. 4 and the prior art transformer 10 of FIG. 1 is the type of shields 100, 109, 111 used. In the transformer of FIG. 4, two outer shields 109, 111 are wound about the outer layers of the high voltage winding sections 140, 160, and one inner shield 100 is wound between the inner layers of the high voltage winding sections 140, 160 and the inter winding insulation 270 that insulates the high voltage winding 120 from the low voltage winding 260. As explained with reference to FIG. 3, the shield wire diameter SD of each of the shields 100, 109, 111 is at least ten times the high voltage wire diameter HVD. It is noted that at least one layer of insulation (not shown) is wound around the outer shields 109, 111. However, this insulation has been omitted from FIGS. 4 and 5 for purposes of clarity.

Finally, it is noted that, when the voltage transformer 110 is made from two equal high voltage winding sections 140, 160, the high voltage winding sections 140, 160 must be connected at the starting end 105 and finishing end 107 of the windings of the shield 100 and by a central wire 121 to one of the intermediate turns 109 of the shield 100.

Figure 5:
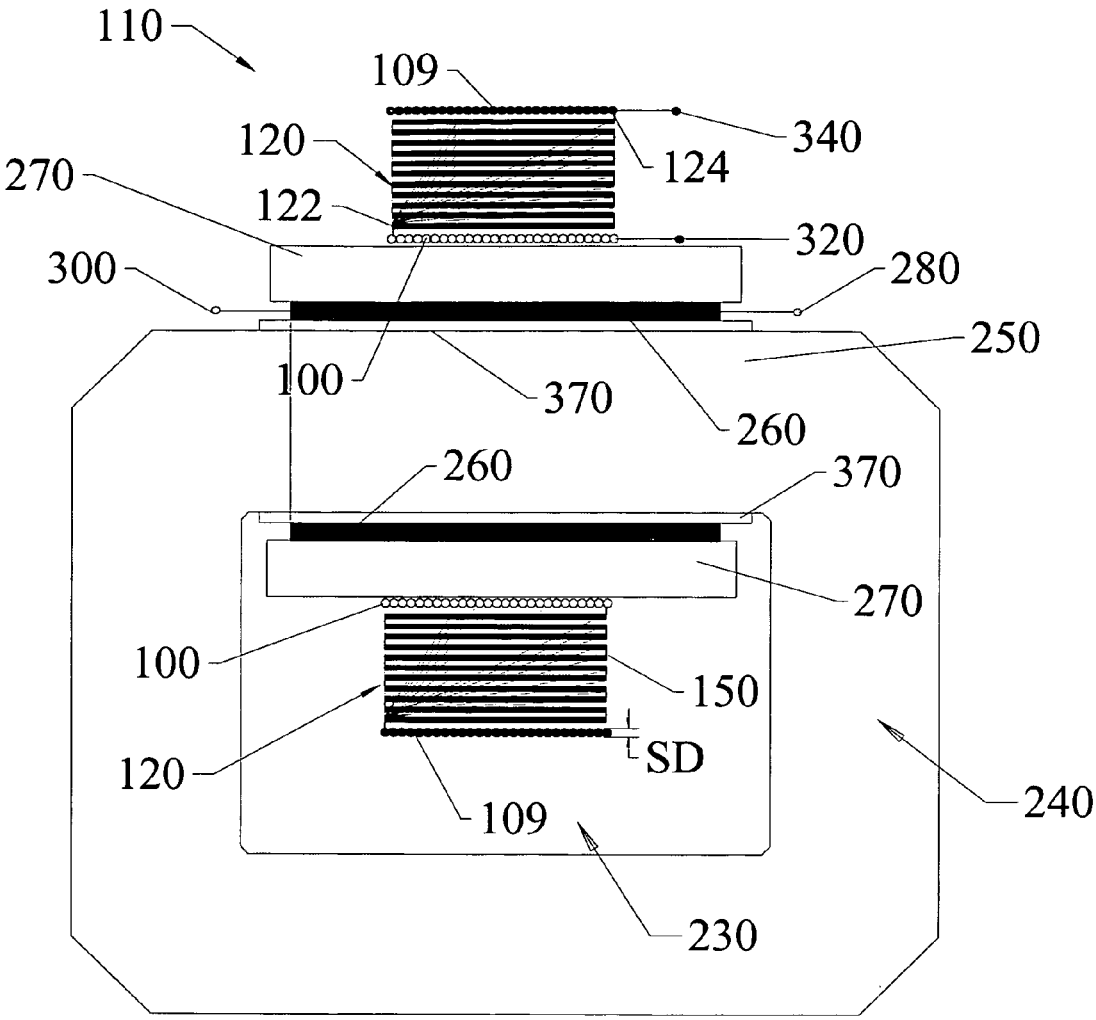
FIG. 5 is a cross sectional view of a voltage transformer of the present invention constructed from one section for operation between lines in which the electrostatic shield of the present invention is utilized.

Referring now to FIG. 5, another embodiment of a transformer 110 in accordance with the present invention is shown. Like the prior art transformer of FIG. 2, the transformer 110 includes a magnetic core 240 in which a low voltage winding 260 and high voltage winding 120 are disposed. The low voltage winding 260 is in electrical communication with a pair of low voltage leads 280, 300 that extend outside of the magnetic core 240. However, in this type of transformer 110, the high voltage winding 120 is made from a single high voltage winding section 150, which is connected to the shield 100 at the starting end 122 and finishing end 124 of the high voltage winding 120.

Due the fact that, in the voltage transformers, the number of volts per turn is in the low voltage range; i.e. in the range of approximately one Volt per turn, because of the small magnetic core cross section and very large number of turns, the induced voltage in the shield 100 will be very low; ex. 10-30 Volts. In fact, the induced voltage in the shield 100 will be ten or more times lower than the induced voltage in high voltage winding 120. Accordingly, the shield 100 can be approximately considered as a quasi-equipotential electrode insofar as it provides more uniform capacitance so it better controls voltage distribution and, thus, enhances the impulse characteristic of the transformer.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. An electrostatic shield for a voltage transformer having a high voltage winding formed from a high voltage winding wire having a high voltage winding wire diameter, wherein said electrostatic shield comprises:

a coil comprising a plurality of windings of a substantially round shield wire, said coil comprising a first turn terminating in a starting end, a last turn terminating in a finishing end, and a plurality of intermediate turns, wherein said first turn, last turn and plurality of intermediate turns define an inside shield coil surface and an outer shield coil surface; and a layer of insulation disposed about a substantial portion of said shield wire, wherein said layer of insulation terminates a sufficient distance from said starting end and said finishing end to allow said starting end and said finishing end to be electrically connected to the high voltage winding;

wherein said inside shield coil surface is dimensioned to surround the high voltage winding; and wherein said shield wire has a shield wire diameter that is at least ten times the high voltage winding wire diameter.

2. The electrostatic shield as claimed in claim 1 wherein said shield wire is a copper wire.

3. The electrostatic shield as claimed in claim 1 wherein said shield wire diameter is between 0.05 inches and 0.12 inches.

4. A voltage transformer comprising:

a magnetic core;

a low voltage winding;

a pair of low voltage leads in electrical communication with said low voltage winding;

a high voltage winding formed from a high voltage winding wire having a high voltage winding wire diameter;

a pair of high voltage leads in electrical communication with said high voltage winding; and an electrostatic shield comprising:

an inner shield coil and an outer shield coil, wherein each of said inner shield coil and said outer shield coil comprises a plurality of windings of a substantially round shield wire, said wherein each of said inner shield coil and said outer shield coil comprises a first turn terminating in a starting end, a last turn terminating in a finishing end, and a plurality of intermediate turns, wherein said first turn, last turn and plurality of intermediate turns define an inside inner shield coil surface and an outside inner shield coil surface, and wherein each of said inner shield coil and said outer shield coil are connected to said high voltage winding; and a layer of insulation disposed about a substantial portion of said shield wire of said outer shield coil and said inner shield coil, wherein said layer of insulation terminates a sufficient distance from said starting end and said finishing end to allow said starting end and said finishing end to be electrically connected to said high voltage winding;

wherein said inside shield coil surface of said outer shield coil surrounds and is substantially proximate to the high voltage winding;

wherein said outer shield coil surface of said inner shield coil surrounds and is substantially proximate to the high voltage winding; and wherein said shield wire has a shield wire diameter that is at least ten times the high voltage winding wire diameter.

5. The voltage transformer as claimed in claim 4:

wherein said high voltage winding comprises a first high voltage winding section, a second high voltage winding section, and a space separating said first high voltage winding section and said second high voltage winding section; and wherein said outer shield coil comprises a first outer shield coil surrounding said first high voltage winding section and a second outer shield coil surrounding said second high voltage winding section.

6. The voltage transformer as claimed in claim 5:

wherein said first high voltage winding section and said second high voltage winding section of said transformer are connected by a central wire; and wherein said central wire is connected to said inner shield.

7. The voltage transformer as claimed in claim 5 wherein said shield wire is a copper wire.

8. The voltage transformer as claimed in claim 7 wherein said diameter of said shield wire is between 0.05 inches and 0.12 inches.

9. The voltage transformer as claimed in claim 7 wherein said shield and said high voltage coil are sized and dimensioned such that an induced voltage in said shield is less then thirty Volts.

10. The voltage transformer as claimed in claim 7 wherein said shield and said high voltage coil are sized and dimensioned such that an induced voltage in said shield is at least ten times lower than an induced voltage in said high voltage winding.

11. The voltage transformer as claimed in claim 7 wherein said shield and said high voltage coil are sized and dimensioned such that said transformer provides substantially uniform capacitance.

12. The voltage transformer as claimed in claim 7 wherein said transformer is a medium voltage resin cast transformer.

* * * * *